US007878128B2

(12) United States Patent
Watson et al.

(10) Patent No.: US 7,878,128 B2
(45) Date of Patent: Feb. 1, 2011

(54) PIVOTABLE BOARD PROVIDED WITH LEGS

(75) Inventors: Ronnie K. Watson, Flower Mound, TX (US); Robert L. Stewart, Grapevine, TX (US); Lopa Patel, Bedford, TX (US); Jennifer Ellen Davis-Wilson, San Francisco, CA (US); Craig M. Lawrence, Menlo Park, CA (US); Steven Bishop, Mountain View, CA (US); Emily Ma, Atherton, CA (US); James Yurchenco, Palo Alto, CA (US); Christian Cornelius, Stuttgart (DE); Phillip Stob, Fremont, CA (US)

(73) Assignee: Steelcase Development Corporation, Grand Rapids, MI (US)

( * ) Notice: Subject to any disclaimer, the term of this patent is extended or adjusted under 35 U.S.C. 154(b) by 601 days.

(21) Appl. No.: 11/756,158

(22) Filed: May 31, 2007

(65) Prior Publication Data

US 2007/0261613 A1 Nov. 15, 2007

Related U.S. Application Data

(63) Continuation-in-part of application No. 10/491,260, filed as application No. PCT/EP02/10977 on Oct. 1, 2002, now Pat. No. 7,634,968.

(30) Foreign Application Priority Data

Oct. 2, 2001 (DE) ..... 201 18 884

(51) Int. Cl.
*A47B 3/00* (2006.01)

(52) U.S. Cl. ..... 108/132; 108/115; 248/188.6

(58) Field of Classification Search ..... 108/132, 108/115, 124, 123, 128, 6, 50.01, 50.02; 248/188.6, 188.7, 188.1
See application file for complete search history.

(56) References Cited

U.S. PATENT DOCUMENTS 275,598 A 4/1883 Crandall (Continued)

FOREIGN PATENT DOCUMENTS

CH 681850 6/1993

(Continued)

OTHER PUBLICATIONS

Versteel, "TIM (Tables in Motion)," 5 page printout from web site, 2001.

(Continued)

*Primary Examiner*—José V Chen
(74) *Attorney, Agent, or Firm*—Quarles & Brady LLP

(57) ABSTRACT

A system includes a board having opposing surfaces and at least one leg connected to one surface of the board through a first pivotable fitting to allow the board and the leg to move between a first position wherein the board and the leg are substantially parallel and a second position wherein the board and the leg are substantially perpendicular. The system also includes a locking mechanism secured to the board through a second pivotable fitting at a first end and configured to rotate at a second end opposite the first end between a storage position extending parallel with the board and a work position extending perpendicular to the board.

46 Claims, 12 Drawing Sheets

U.S. PATENT DOCUMENTS

| | | | | | |
|---|---|---|---|---|---|
| 331,149 | A | | 11/1885 | McClure | |
| 346,795 | A | | 8/1886 | Wilcox | |
| 355,230 | A | | 12/1886 | Taliaferro | |
| 409,544 | A | | 8/1889 | Ziegler | |
| 489,369 | A | * | 1/1893 | Case | 108/124 |
| 571,980 | A | | 11/1896 | Penfield | |
| 598,077 | A | | 2/1898 | Comee | |
| 874,052 | A | | 12/1907 | Cantwell | |
| 881,556 | A | | 3/1908 | Dehler | |
| 948,905 | A | | 2/1910 | Snyder | |
| 1,200,071 | A | | 10/1916 | Barler | |
| 1,341,988 | A | | 6/1920 | Koechlin | |
| 1,735,162 | A | | 11/1929 | Favour | |
| 1,872,849 | A | | 8/1932 | Townes | |
| 1,912,096 | A | | 5/1933 | Reuter | |
| 1,939,459 | A | | 12/1933 | Murray | |
| 1,981,052 | A | | 11/1934 | Lehner | |
| 2,174,952 | A | | 10/1939 | Spikings, Jr. | |
| 2,397,405 | A | | 3/1946 | Burkeman | |
| 2,520,469 | A | | 8/1950 | Mowrey | |
| D164,295 | S | | 8/1951 | Gierlich | |
| 2,572,474 | A | * | 10/1951 | Hamilton | 108/132 |
| 2,739,860 | A | | 3/1956 | Wilson | |
| 2,741,868 | A | | 4/1956 | Saunders | |
| 2,771,937 | A | | 11/1956 | Wilson | |
| 2,791,477 | A | | 5/1957 | Wesbecher | |
| 3,188,158 | A | | 6/1965 | Sanchez | |
| 3,217,673 | A | * | 11/1965 | Knoblock | 108/159.11 |
| 3,276,401 | A | | 10/1966 | Wilson et al. | |
| 3,401,653 | A | * | 9/1968 | Knoblock | 108/124 |
| 3,543,312 | A | | 12/1970 | Pofferi | |
| 3,598,390 | A | | 8/1971 | Armitage | |
| 3,604,372 | A | * | 9/1971 | Hewett et al. | 108/160 |
| 3,618,704 | A | | 11/1971 | Smith, Sr. | |
| 3,641,946 | A | | 2/1972 | Charnay | |
| 3,696,762 | A | | 10/1972 | Holdham | |
| 3,785,299 | A | | 1/1974 | Caperton, Jr. | |
| 3,786,766 | A | | 1/1974 | Chiariello | |
| 3,796,169 | A | | 3/1974 | Bales et al. | |
| 3,805,710 | A | | 4/1974 | Leshem | |
| 3,818,844 | A | * | 6/1974 | Burr | 108/132 |
| 3,861,325 | A | | 1/1975 | Bue et al. | |
| 3,903,812 | A | | 9/1975 | Cowley | |
| 3,951,233 | A | | 4/1976 | Meyers | |
| 3,993,004 | A | | 11/1976 | Alme | |
| 4,097,037 | A | | 6/1978 | Tardiff | |
| 4,099,469 | A | | 7/1978 | Sahli | |
| 4,108,083 | A | | 8/1978 | Espinosa | |
| 4,136,622 | A | | 1/1979 | Bue et al. | |
| 4,191,111 | A | | 3/1980 | Emmert | |
| 4,196,675 | A | | 4/1980 | Cook | |
| 4,305,581 | A | | 12/1981 | Neuharth | |
| 4,350,098 | A | | 9/1982 | Shirono | |
| 4,372,631 | A | | 2/1983 | Leon | |
| 4,383,486 | A | | 5/1983 | Reineman et al. | |
| 4,387,650 | A | | 6/1983 | Pizzi | |
| 4,643,105 | A | | 2/1987 | Baum | |
| 4,645,162 | A | | 2/1987 | Roy et al. | |
| 4,754,844 | A | | 7/1988 | Sutton | |
| 4,773,337 | A | | 9/1988 | Ball | |
| 4,815,395 | A | | 3/1989 | Trueg | |
| 4,848,243 | A | | 7/1989 | Giordano | |
| 4,879,954 | A | | 11/1989 | Sawamura et al. | |
| 4,943,040 | A | | 7/1990 | Finstad et al. | |
| 4,967,877 | A | | 11/1990 | Wallman et al. | |
| 4,986,195 | A | | 1/1991 | Diffrient | |
| 4,986,501 | A | | 1/1991 | Simon | |
| 5,056,780 | A | | 10/1991 | Tsang | |
| 5,058,965 | A | | 10/1991 | Thorn | |
| 5,117,986 | A | | 6/1992 | Lin | |
| 5,119,903 | A | | 6/1992 | Ulshafer, Jr. | |
| 5,121,697 | A | | 6/1992 | Baum et al. | |
| 5,131,333 | A | | 7/1992 | Karasawa et al. | |
| 5,154,127 | A | | 10/1992 | Booth | |
| 5,161,766 | A | | 11/1992 | Arima | |
| 5,174,225 | A | | 12/1992 | Reise et al. | |
| 5,197,393 | A | | 3/1993 | Yeakle | |
| 5,205,223 | A | | 4/1993 | Ball et al. | |
| 5,337,657 | A | | 8/1994 | Diffrient | |
| 5,354,027 | A | | 10/1994 | Cox | |
| 5,445,085 | A | | 8/1995 | Westerburgen | |
| 5,528,997 | A | | 6/1996 | Miller | |
| 5,638,761 | A | * | 6/1997 | Berkowitz et al. | 108/132 |
| 5,657,703 | A | | 8/1997 | Johnson | |
| 5,746,660 | A | | 5/1998 | Grover | |
| 5,765,911 | A | | 6/1998 | Sorenson | |
| 5,865,124 | A | | 2/1999 | Wroe | |
| 5,927,214 | A | | 7/1999 | Schwartz et al. | |
| 6,070,367 | A | | 6/2000 | Wagner et al. | |
| 6,082,271 | A | | 7/2000 | Gosselin et al. | |
| 6,082,838 | A | | 7/2000 | Bissu-Palombo | |
| 6,085,669 | A | | 7/2000 | Marchand et al. | |
| 6,119,605 | A | | 9/2000 | Agee | |
| 6,145,800 | A | | 11/2000 | Watkins | |
| 6,164,217 | A | | 12/2000 | Prendergast | |
| 6,170,407 | B1 | | 1/2001 | Hayward | |
| 6,192,808 | B1 | | 2/2001 | Bue | |
| D443,440 | S | | 6/2001 | Deimen et al. | |
| 6,314,892 | B1 | | 11/2001 | Favini | |
| 6,336,414 | B1 | | 1/2002 | Stewart et al. | |
| 6,354,227 | B1 | | 3/2002 | Feldpausch | |
| 6,425,567 | B2 | | 7/2002 | Schutze | |
| 6,550,405 | B2 | | 4/2003 | Gosselin | |
| 6,553,918 | B2 | | 4/2003 | Brieza | |
| 6,564,903 | B2 | | 5/2003 | Krajec | |
| 6,575,103 | B1 | | 6/2003 | Holdredge et al. | |
| 6,637,352 | B1 | | 10/2003 | Thode et al. | |
| 6,647,900 | B1 | * | 11/2003 | Kopish | 108/50.02 |
| 6,662,731 | B2 | | 12/2003 | Teppo et al. | |
| 6,681,704 | B1 | | 1/2004 | Brookhiser | |
| 6,752,090 | B2 | * | 6/2004 | Schenker et al. | 108/115 |
| 6,817,302 | B2 | * | 11/2004 | Norstad | 108/115 |
| 6,817,303 | B2 | | 11/2004 | Gosselin | |
| 6,845,723 | B2 | | 1/2005 | Kottman et al. | |
| 7,634,968 | B2 | * | 12/2009 | Cornelius | 108/115 |
| 2003/0173472 | A1 | | 9/2003 | Liu | |
| 2005/0039642 | A1 | | 2/2005 | Cornelius | |
| 2005/0235886 | A1 | | 10/2005 | Koning et al. | |
| 2005/0252426 | A1 | | 11/2005 | Blasen et al. | |

FOREIGN PATENT DOCUMENTS

| | | |
|---|---|---|
| DE | 9417585.3 | 2/1995 |
| DE | 19837987 | 3/2000 |
| DE | 100 38 223 | 2/2002 |
| DE | 10316246 | 12/2003 |
| EP | 0392817 | 10/1990 |
| EP | 0453401 | 1/1996 |
| EP | 1308109 | 5/2003 |
| EP | 1159887 | 10/2003 |
| JP | 55-100535 | 7/1980 |
| JP | 56-37619 | 9/1981 |
| JP | 11-18840 | 5/1989 |
| JP | 10-215952 | 10/1990 |
| JP | 11-56480 | 3/1999 |
| JP | 2000-60646 | 2/2000 |
| JP | 2002-223859 | 8/2002 |
| JP | 2003-507107 | 2/2003 |
| JP | 2003-180453 | 7/2003 |
| JP | 2003-339446 | 12/2003 |
| JP | 2004-267429 | 9/2004 |
| WO | WO 90/03132 | 4/1990 |
| WO | WO 01/13762 | 3/2001 |
| WO | WO 01/13762 A1 | 3/2001 |

| | | |
|---|---|---|
| WO | WO 02/102193 | 12/2002 |
| WO | WO 03/030683 | 4/2003 |

OTHER PUBLICATIONS

Gibraltar, "Metal Table Bases and Legs," 2 page printout from web site, Oct. 6, 2005.
Fliptop, "The flexible Solution," 4 page printout, not dated.
U.S. Appl. No. 10/491,260, Notice of Allowance and Fees Due, Aug. 7, 2009.
U.S. Appl. No. 10/491,260, Amendment After Final or under 37 CFR 1.312, Aug. 7, 2009.
U.S. Appl. No. 10/491,260, Examiner Interview Summary Record, May 21, 2009.
U.S. Appl. No. 10/491,260, Amendment After Final, May 15, 2009.
U.S. Appl. No. 10/491,260, Claims, May 15, 2009.
U.S. Appl. No. 10/491,260, Applicant Arguments/Remarks Made in an Amendment, May 15, 2009.
U.S. Appl. No. 10/491,260 Examiner Interview Summary Record, Feb. 19, 2009.
U.S. Appl. No. 10/491,260, Final Rejection, Feb. 19, 2009.
U.S. Appl. No. 10/491,260, Amendment/Req. Reconsideration After Non-Final Reject, Nov. 21, 2008.
U.S. Appl. No. 10/491,260, Claims, Nov. 21, 2008.
U.S. Appl. No. 10/491,260, Applicant Arguments/Remarks Made in an Amendment, Nov. 21, 2008.
U.S. Appl. No. 10/491,260, Transmittal Letter, Nov. 21, 2008.
U.S. Appl. No. 10/491,260, Non-Final Rejection, Jul. 22, 2008.
U.S. Appl. No. 10/491,260, Pre-Brief Appeal Conference decision, May 14, 2008.
U.S. Appl. No. 10/491,260, Pre-Brief Conference Request, Apr. 18, 2008.
U.S. Appl. No. 10/491,260, Applicant summary of interview with examiner, Mar. 20, 2008.
U.S. Appl. No. 10/491,260, Examiner Interview Summary Record, Feb. 26, 2008.
U.S. Appl. No. 10/491,260, Final Rejection, Dec. 20, 2007.
U.S. Appl. No. 10/491,260, Amendment/Req. Reconsideration-After Non-Final Reject, Oct. 5, 2007.
U.S. Appl. No. 10/491,260, Claims, Oct. 5, 2007.
U.S. Appl. No. 10/491,260, Applicant Arguments/Remarks Made in an Amendment, Oct. 5, 2007.
U.S. Appl. No. 10/491,260, Non-Final Rejection, Jun. 5, 2007.
U.S. Appl. No. 10/491,260, Amendment Submitted/Entered with Filing of CPA/RCE, Mar. 27, 2007.
U.S. Appl. No. 10/491,260, Claims, Mar. 27, 2007.
U.S. Appl. No. 10/491,260, Applicant Arguments/Remarks Made in an Amendment, Mar. 27, 2007.
U.S. Appl. No. 10/491,260, Advisory Action, Jan. 19, 2007.
U.S. Appl. No. 10/491,260, Amendment After Final or under 37 CFR 1.312, Jan. 19, 2007.
U.S. Appl. No. 10/491,260, Amendment After Final, Dec. 26, 2006.
U.S. Appl. No. 10/491,260, Claims, Dec. 26, 2006.
U.S. Appl. No. 10/491,260, Applicant Arguments/Remarks Made in an Amendment, Dec. 26, 2006.
U.S. Appl. No. 10/491,260, Final Rejection, Oct. 27, 2006.
U.S. Appl. No. 10/491,260, Amendment/Req. Reconsideration-After Non-Final Rject, Aug. 15, 2006.
U.S. Appl. No. 10/491,260, Claims, Aug. 15, 2006.
U.S. Appl. No. 10/491,260, Applicant Arguments/Remarks Made in an Amendment, Aug. 15, 2006.
U.S. Appl. No. 10/491,260, Non-Final Rejection, Jun. 6, 2006.
U.S. Appl. No. 10/491,260, Amendment Submitted/Entered with Filing of CPA/RCE, Mar. 24, 2006.
U.S. Appl. No. 10/491,260, Claims, Mar. 24, 2006.
U.S. Appl. No. 10/491,260, Applicant Amendment/Remarks Made in an Amendment, Mar. 24, 2006.
U.S. Appl. No. 10/491,260, Final Rejection, Sep. 28, 2005.
U.S. Appl. No. 10/491,260, Amendment/Req. Reconsideration-After Non-Final Reject, Jul. 14, 2005.
U.S. Appl. No. 10/491,260, Specification, Jul. 14, 2005.
U.S. Appl. No. 10/941,260, Claims, Jul 14, 2005.
U.S. Appl. No. 10/491,260, Applicant Arguments/Remarks Made in an Amendment, Jul. 14, 2005.
U.S. Appl. No. 10/491,260, Non-Final Rejection, Apr. 22, 2005.
EP Application No. 02 781 197.5, Communication Pursuant to Article 96(2), Mar. 22, 2007.
English Language Translation of EP Application No. 02 781 197.5, Communication Pursuant to Article 96(2), Mar. 22, 2007.
EP Application No. 02 781 197.5, Response, Aug. 31, 2007.
English Language Translation of EP Application No. 02 781 197.5, Response, Aug. 31, 2007.

* cited by examiner

PIVOTABLE BOARD PROVIDED WITH LEGS

CROSS-REFERENCE TO RELATED APPLICATIONS

This application is a continuation-in-part and claims the benefit of U.S. patent application Ser. No. 10/491,260, filed Sep. 28, 2004, and entitled "Pivotable Board Provided With Legs," now U.S. Pat. No. 7,634,968 issued Dec. 22, 2009, and which claims the benefit of PCT International Application No. PCT/EP02/10977, filed Oct. 1, 2002, and entitled "Pivotable Board Provided With Legs," which claims the benefit of Prior Foreign Application DE 20118884.8, filed Oct. 2, 2001.

STATEMENT REGARDING FEDERALLY SPONSORED RESEARCH OR DEVELOPMENT

Not applicable.

BACKGROUND OF THE INVENTION

The present invention is related to table systems and, more particularly, to a table system configured to rotate and lock in either a work orientation or a storage position.

Boards, preferably tabletops, can be used, for example, as folding tables, which are used in a variety of environments. It is desirable to tilt the board into a slanted position, in the same manner whereby a board is used as an easel or a drawing board, or to tilt the board into a vertical position in order to stack several tables into one another in a space-saving manner.

In this context it is known that one may not only tilt the board, but also turn the legs into a space-saving position so that they occupy as little space as possible in front of the vertically tilted board. This has been achieved up to now by connecting the board and the legs with separate swiveling axes according to their separate movements towards a space-saving stacking position. In every case, tabletop and legs and/or their supporting structures must each be individually positioned into their desired end-positions.

Such a folding table is, for instance, known by DE 9417585 U1. However, its handling is rather complicated. For instance, in order to turn the legs or the related support structure into a desired end-position, the exact horizontal position of the board to be tilted must first be manually secured and then the board must then be manually put into a vertical position.

To swivel this board into a working position, it must first be manually turned into a horizontal position and kept there manually until the legs or their related support structure can be securely turned towards their supporting end-position. However, this design hardly offers a convenient way of handling a fliptop table.

The same might be said about the table known under DE 198 37 987 A1. It includes a coupling that turns the vertically pivoted leg and/or their support part together with the horizontally pivoted tabletop. Such a mechanism not only requires a lot of force but, in order to be effected, it needs casters on a flat, horizontal ground. Moreover, its construction is complicated, expensive and mechanically susceptible and, therefore, unsatisfactory.

The aim of the present invention, by contrast, is to create a board with leg or support structure of the genre with as little constructive effort as possible and, thus, to offer simple and comfortable handling, in order to swivel the board and legs simultaneously.

SUMMARY OF THE INVENTION

The present invention overcomes the aforementioned drawbacks by providing a flip table that is configured to simultaneously move the board and the legs of the table between a storage position and a working position, and lock therein.

In accordance with one aspect of the invention, a board system includes a worksurface and at least one leg engaged at a first end with the worksurface to support the worksurface. The system also includes a first pivotable fitting securing the leg to the worksurface to allow the worksurface to be rotated along a first path between a first position where the worksurface is substantially perpendicular to the leg and a second position where the worksurface is substantially parallel with the leg. The system further includes a locking mechanism extending from a first end secured to the worksurface through a second pivotable fitting to a second end configured to rotate between a storage position where the locking mechanism extends substantially parallel with the worksurface to a work position where the locking mechanism extends substantially perpendicular to the worksurface and engages the leg to lock the worksurface in the first position.

In accordance with another aspect of the invention, a system includes a board having opposing surfaces and at least one leg connected to one surface of the board through a first pivotable fitting to allow the board and the leg to move between a first position wherein the board and the leg are substantially parallel and a second position wherein the board and the leg are substantially perpendicular. The system also includes a locking mechanism secured to the board through a second pivotable fitting at a first end and configured to rotate at a second end opposite the first end between a storage position extending parallel with the board and a work position extending perpendicular to the board.

Various other features of the present invention will be made apparent from the following detailed description and the drawings.

DETAILED DESCRIPTION OF THE INVENTION

Figure 1:
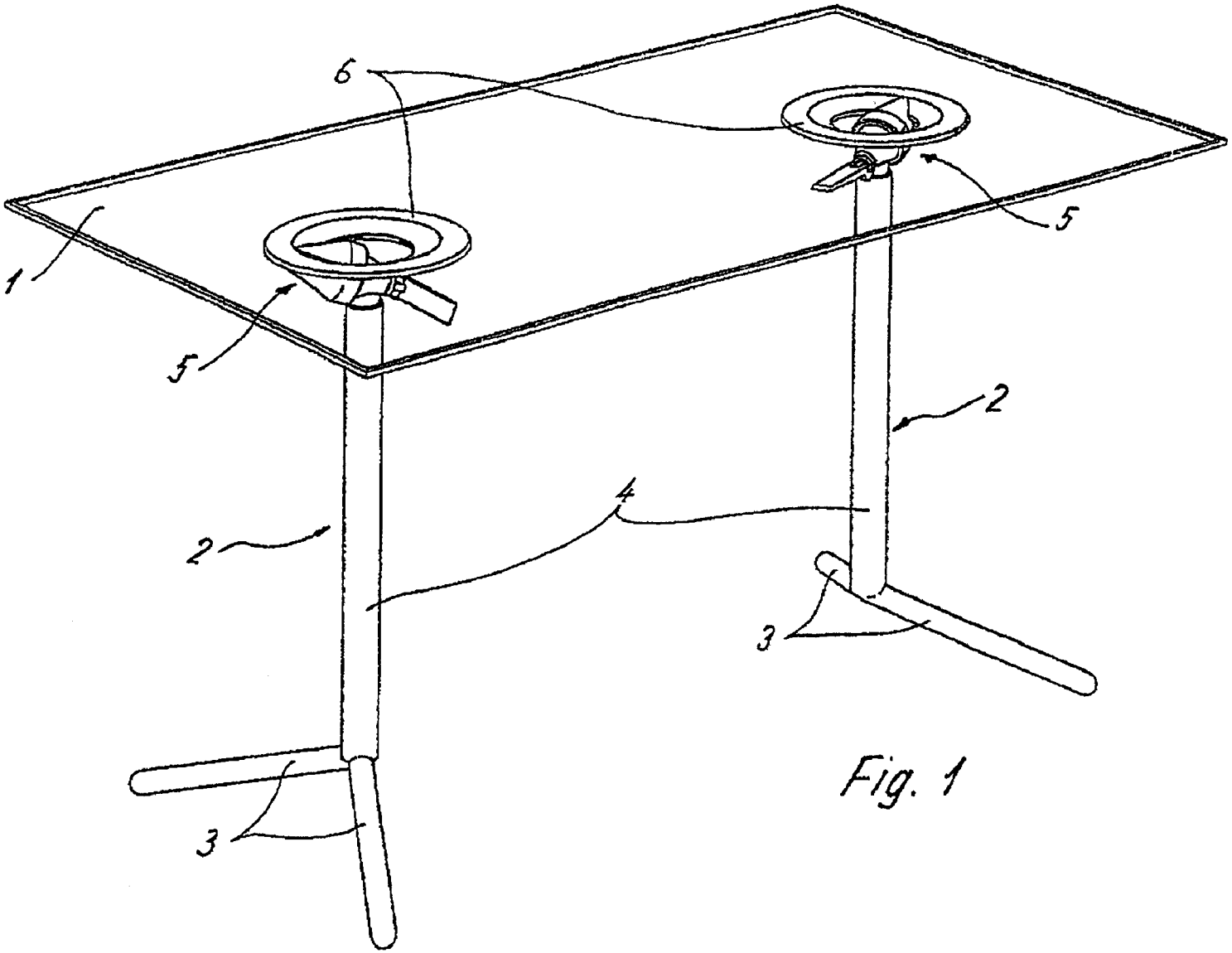
FIG. 1 is a folding table according to the invention in perspective view.
Figure 2:
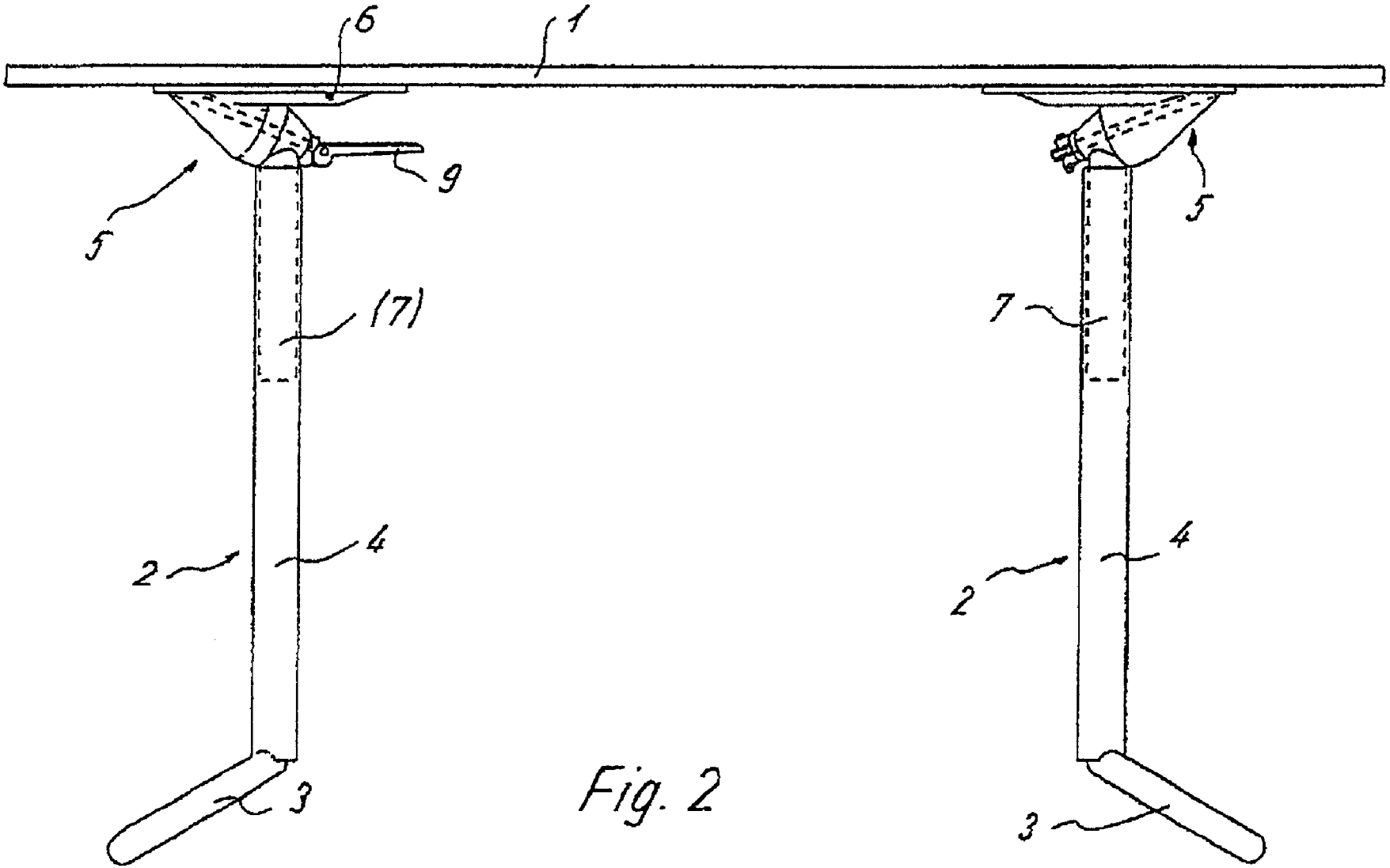
FIG. 2 shows the folding table in front view.
Figure 3:
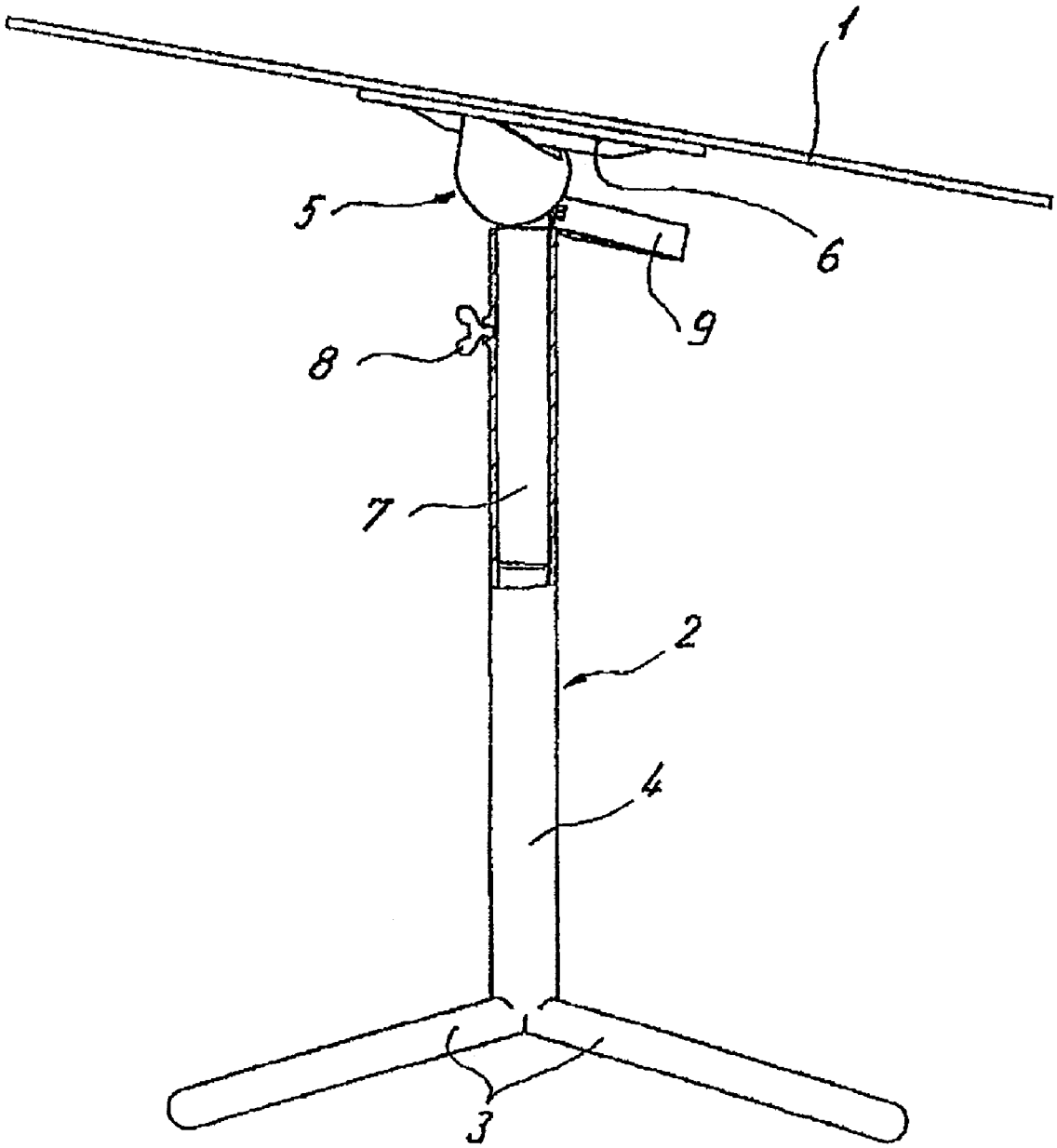
FIG. 3 shows the folding table in side view with its board in a slanted work position.
Figure 4:
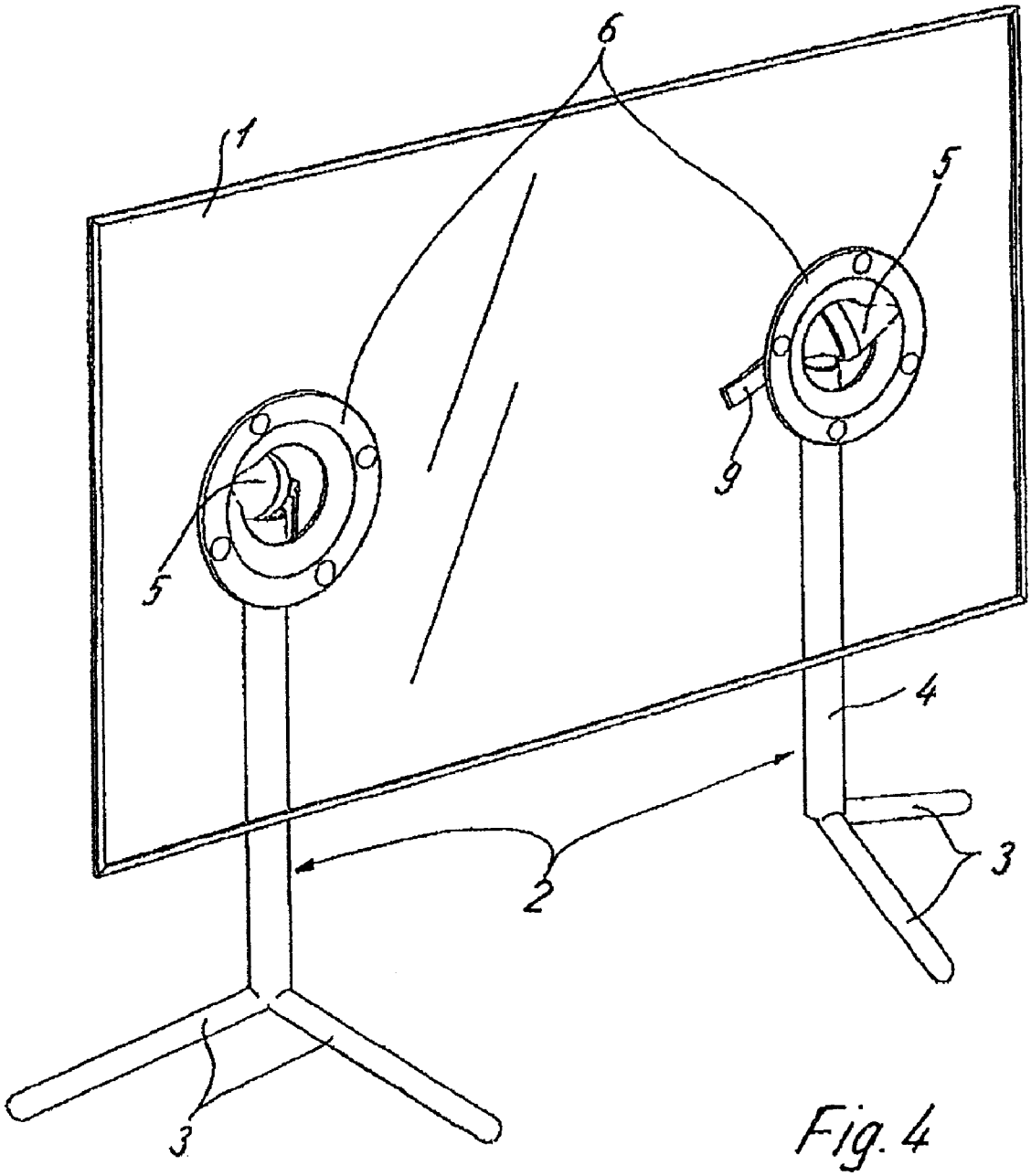
FIG. 4 shows the folding table in a perspective view with its board in a vertical storage position.

FIGS. 1-4 show a folding table in a basic configuration with a board 1 built as a transparent tabletop and two legs 2, which are connected by means of pivotable fittings 5 to the board 1 through which board 1, as well as leg 2, dependently move from a horizontally working position, as shown in FIG. 1 and FIG. 2, into a storage position according to FIG. 4. The latter figure shows board 1 in a vertical position and the legs 2 pivotally moved inwards so that they occupy as little space as possible in front of board 1 and on the ground.

Each leg 2 includes of a tubular post 4 with two cross bars or feet 3 extending radially from its bottom end towards the ground. Each pivotable fitting 5 is attached to the bottom side of the board 1 by a mounting plate 6 and led into the tubular post 4 by means of a tubular connector 7 that is tightened through a thumb-screw 8 thus connecting leg 2 in a height-adjustable and torsionally-stiff manner.

FIG. 3 shows an inclined position of board 1, most beneficial, for example, when used as a working platform. As shown evidently in FIG. 6, the pivotable fitting 5 possesses in this present formation a funneled case 12, which is fixedly joined to the mounting plate 6. The funneled case 12 contains a cone-shaped area tapering towards the tabletop. A conical member 13 is supported herein that is joined to the already described tubular connector 7 inserting into the tubular post 4.

Case 12 and conical member 13 share a longitudinal axis that is spatially slanted with respect to the board, thus creating a hinge that swivels board 1 as well as leg 2. By doing so, both conical members 13 rotate in the fixedly mounted cases 12 in a way that the opposing cross bars 3 swivel towards one another into an end position, as shown in FIG. 4 and FIG. 5.

Figure 5:
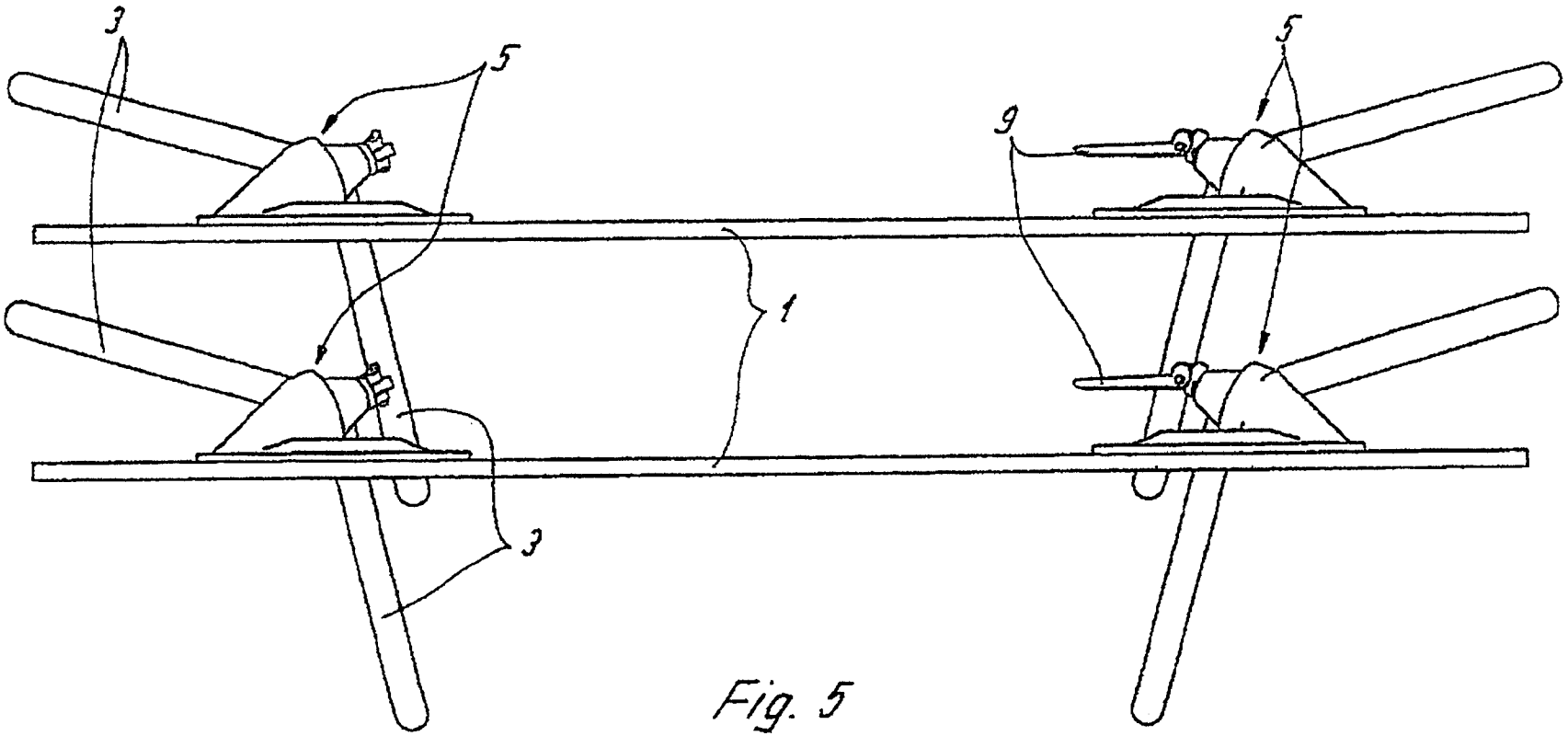
FIG. 5 shows a top view of two folding tables with their boards in a vertical storage position stacked in one another.
Figure 6:
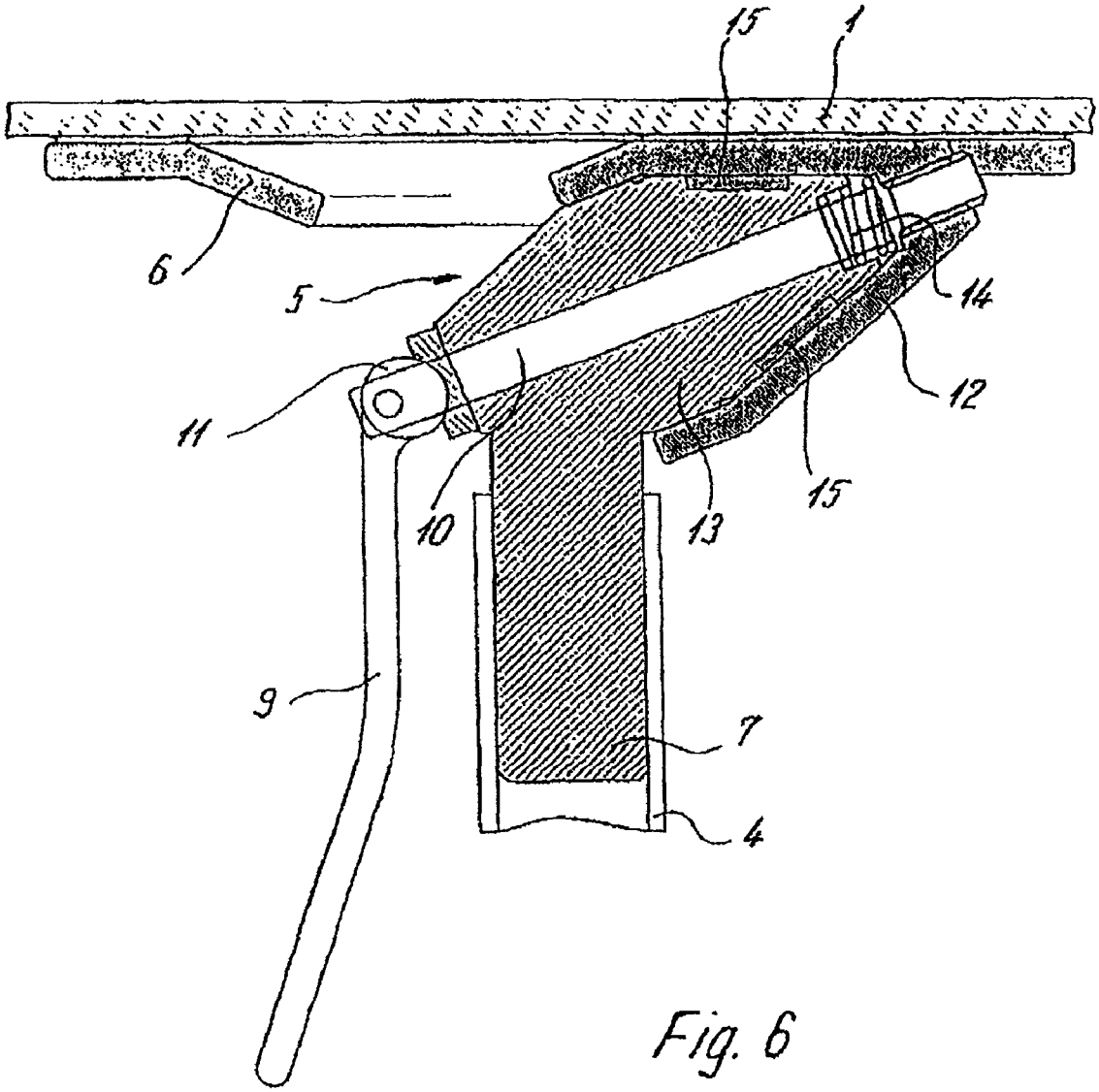
FIG. 6 shows a fragmentary sectional view of the pivot mechanism from the folding table.

FIG. 5 illustrates how the cross bars 3 orient themselves and thereby construct a folding table allowing other similarly designed tables to nest into one another as close as possible. The conical member 13 of the pivotable fitting 5 in FIG. 6 is pivotally supported by a clamping bolt 10, which is screwed into the tapered part closest to board 1 of case 12. In this part, a compression spring 14 is guided onto the clamping bolt 10, pressing against the case 12 and the conical portion 13.

A lever 9 is rotatably connected to the end of the clamping bolt 10, which lies opposite the spring 14. In the area wherein it attaches itself to the clamping bolt 10, the lever 9 contains a lobe 11 that can press against the conical member 13. In order to clamp the conical member 13 into the case 12 to obtain sturdy fixed positions of board 1 and leg 2, the lever 9 is to be rotated with its lobe 11 pressing against the conical member 13. The conical circumferential surface of the conical member 13 simultaneously presses against the inner surface of case 12, thereby achieving a frictional grip. So as to adapt to the necessary friction between conical member 13 and case 12, brake pads 15 are provided onto the conical member 13. These pads also protect conical member 13 and case 12 from unintended abrasion and allow for better adjustability of frictional moments whilst increasing or decreasing pressure with lever 9.

To release the frictional contact needed to swivel board 1, the lever 9 will be activated to release lobe 11 from its clamping position. The pressure spring 14 helps to axially move the conical member 13 led onto the clamping bolt 10 away from contact with case 12. This embodiment of pivotable fitting 5 offers a continuously adjustable tilt-position of the board 1 with respect to the ground while, as said before, legs 2 simultaneously move around an almost vertical axis.

The ensuing movement of the legs 2 on the ground is basically effected by the fact that the pivot axis changes spatial position whilst tilting the board 1 on the ground as a guiding surface. The pivot axis is created herein by case 12 and conical portion 13. Moreover, for each leg 2, the swivel angle adapts to the floor's unevenness and thereby offers the table great stability and sturdiness.

By means of this construction, a simple yet very effective way of coupling the respective movements of the horizontally swiveling board and the vertically swiveling legs is achieved. The characteristic of the present invention is that the pivot axis guides the board, as well as the associated leg, by means of an axle oriented in space. The pivot axis is conveniently mounted onto the board. It can generally also be fixed onto the leg. In every instance, board and leg pivot around a definite spatially oriented axis.

The invention not only relates to the specific use in folding tables, but is also highly suitable for easels, displays, blackboards, reading/mounting supports (i.e. holding devices) whenever simple swiveling of a board is needed to be easily clamped into various oblique positions. This might be done by an arresting facility or tooth-clutch integrated together with the swiveling elements. It is also conceivable to integrate a continuous adjustability, whereby the desired oblique position would then be fixed by a brake facility or alike.

Furthermore, the invention can apply to a table with only one leg. In this case, the pedestal is preferably built by three side arms. The arms can be equipped with casters or gliders, which allow easy movement on the ground around a basically vertical axis. Whilst rotating on the ground, the pedestal moves from a position that offers a horizontal board maximum stability to a position that occupies minimal space in front of a vertical board and on the ground. The latter case, wherein the board is vertically positioned, allows for a very efficient space-saving storage of many similarly designed tables stacking into one another.

In one of the present invention's most beneficial formations, a pivot axis is provided in the shape of a funneled case that is fixedly mounted onto the board and a conical member supported therein. The conical member is connected to the leg. The shared central longitudinal axis, which also builds the axis of symmetry, is spatially slanted and thereby positioned with respect to the board.

In a board provided with two legs, both axes of symmetry are spatially oriented towards one another, so that when the board is swiveled from a horizontal into a vertical position both arms or pedestals positioned in front of the board will rotate towards each other. In the board's exact vertical and/or horizontal position the post of a leg structure is preferably vertical.

It is very beneficial but also easy to make the case and its mount for the board into something decorative, especially by using transparent or decorative boards, since tabletops are known to often interfere with a table's overall impression. Instead of forming a funneled case and conical member the pivot axis can be a formation of a bolt hinged onto the leg and connected with a frame or beam fixedly mounted onto the board. The important characteristic is a spatially slanted position of the pivot axle's slanted position with respect to the surface and the edges, for example, of a tabletop.

Figure 7:
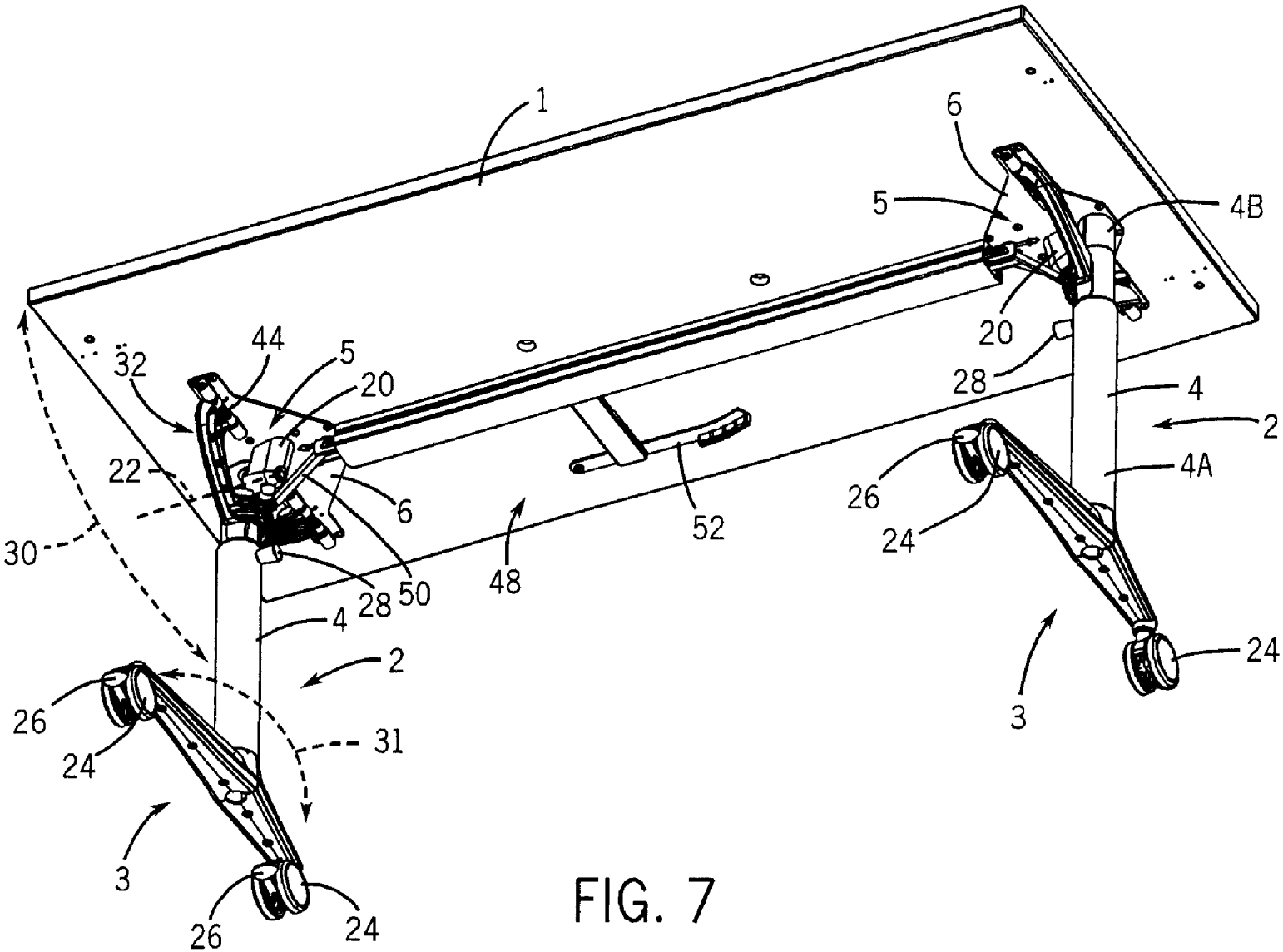
FIG. 7 is a perspective view of an underside of a folding table in a work position.

Referring now to FIG. 7, an embodiment for a folding table system again includes a board or worksurface 1 and a leg 2. The leg 2 includes a post 4 that extends from one end having feet 3 arranged thereat to another end connected to the board 1 through a pivotable fitting 5 and mounting plate 6. In this regard, the folding table system shown in FIG. 7 is similar to that described above. However, as illustrated it is contemplated that the feet 3 may not be angled, while still providing proper nesting with adjacently stored tables, as illustrated in FIG. 5. Furthermore, as will be described below, the table system illustrated in FIGS. 7-11 include a variety of locking and adjustment systems configured to simplify user interactions with the folding table system. While the following description will be made with respect to a folding table system, it is contemplated that these features may equivalently be utilized in other systems, such as an easel, a display, a blackboard, a podium, and the like.

Unlike the above-described system, the pivotable fitting 5 does not include a conical member or portion. Rather, the pivotable fitting 5 includes a base 20 extending in a first direction away from the board 1 and mounting plate 6 to form a pivot axis 22 at an end opposite the board 1 and mounting plate 6 that extends neither parallel with the board 1 nor perpendicular to the board 1 when the board 1 is arranged in the illustrated position with respect to the leg 2. That is, as in the above-described system, the pivotable fitting 5 includes a pivot axis 22 extending in a direction slanted with respect to the board 1 and leg 2.

Figure 10:
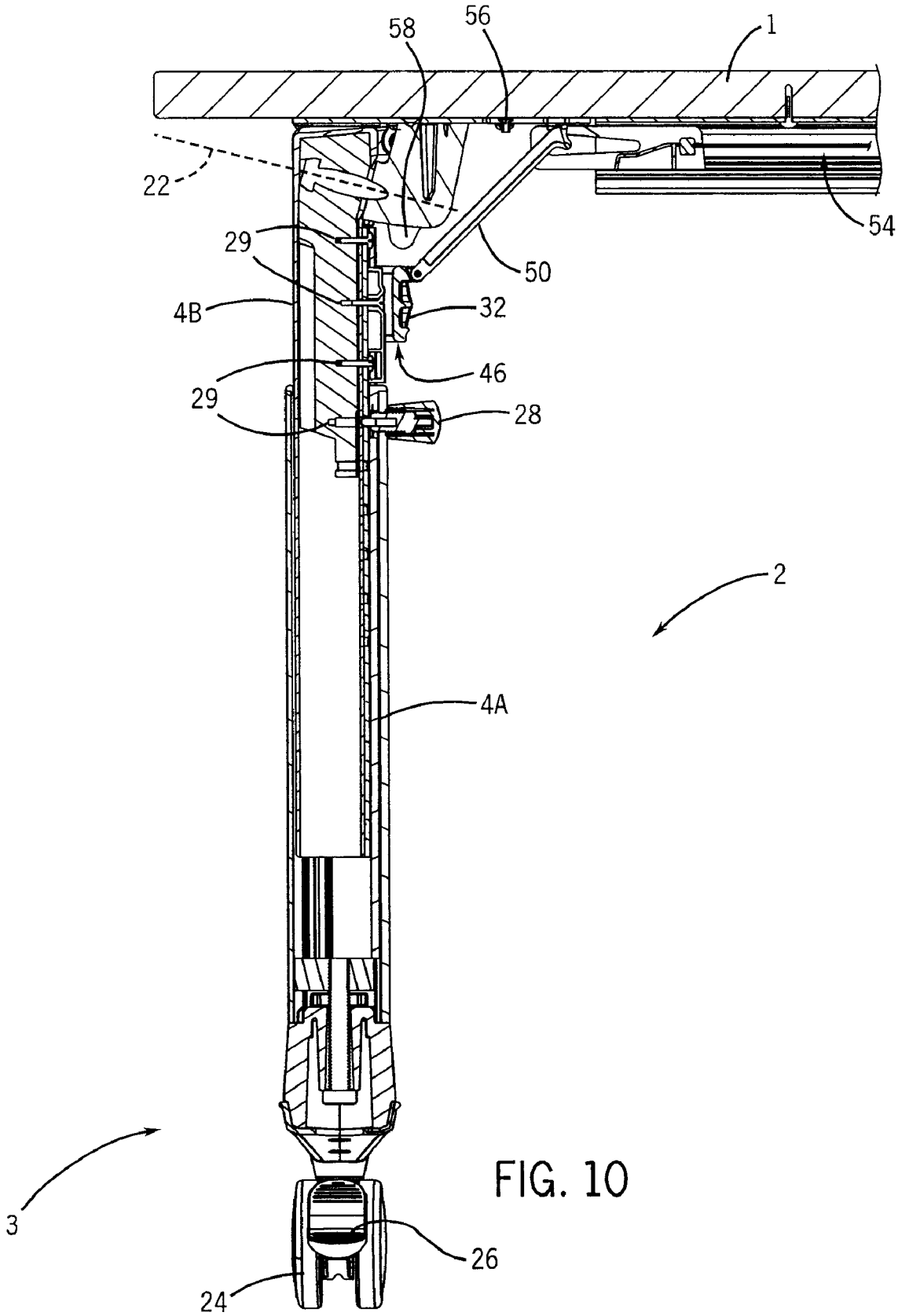
FIG. 10 is a cross-sectional view of a portion of the table of FIGS. 7-9.

As described above, feet 3 are arranged to extend from the legs 2. It is contemplated that the feet 3 may include casters 24, which may further include roller locks 26 that can be engaged to lock the casters 24 and, thereby, the table system, in a desired position. As also described above, the legs 2 include a tubular portion 4. More particularly, it is contemplated that the tubular portion 4 may be formed by two tubular portions 4*a*, 4*b*, whereby one tubular portion 4*b* has a reduced diameter and is designed to extend into the other tubular portion 4*a*. In this regard, the board 1 may be raised by releasing a lock 28 arranged on each leg 2 and moving the board 1 upward, away from the feet 3. It is contemplated that the lock 28 may be biased into a locking position and, therefore, automatically lock the table system in a particular position once movement of the board 1 away from the feet 3 has ceased and the lock 28 is aligned with a reciprocal passage 29 in leg portion 4*b*, as shown in FIG. 10. Additionally, it is contemplated that the tubular portions 4*a*, 4*b* may be biased away from one another to reduce the amount of upward force required to move the board 1 away from the feet 3. While the Figs. and the above description are directed to legs 2 having a tubular shape, it is contemplated that other shaped legs may equivalently be utilized.

Figure 8:
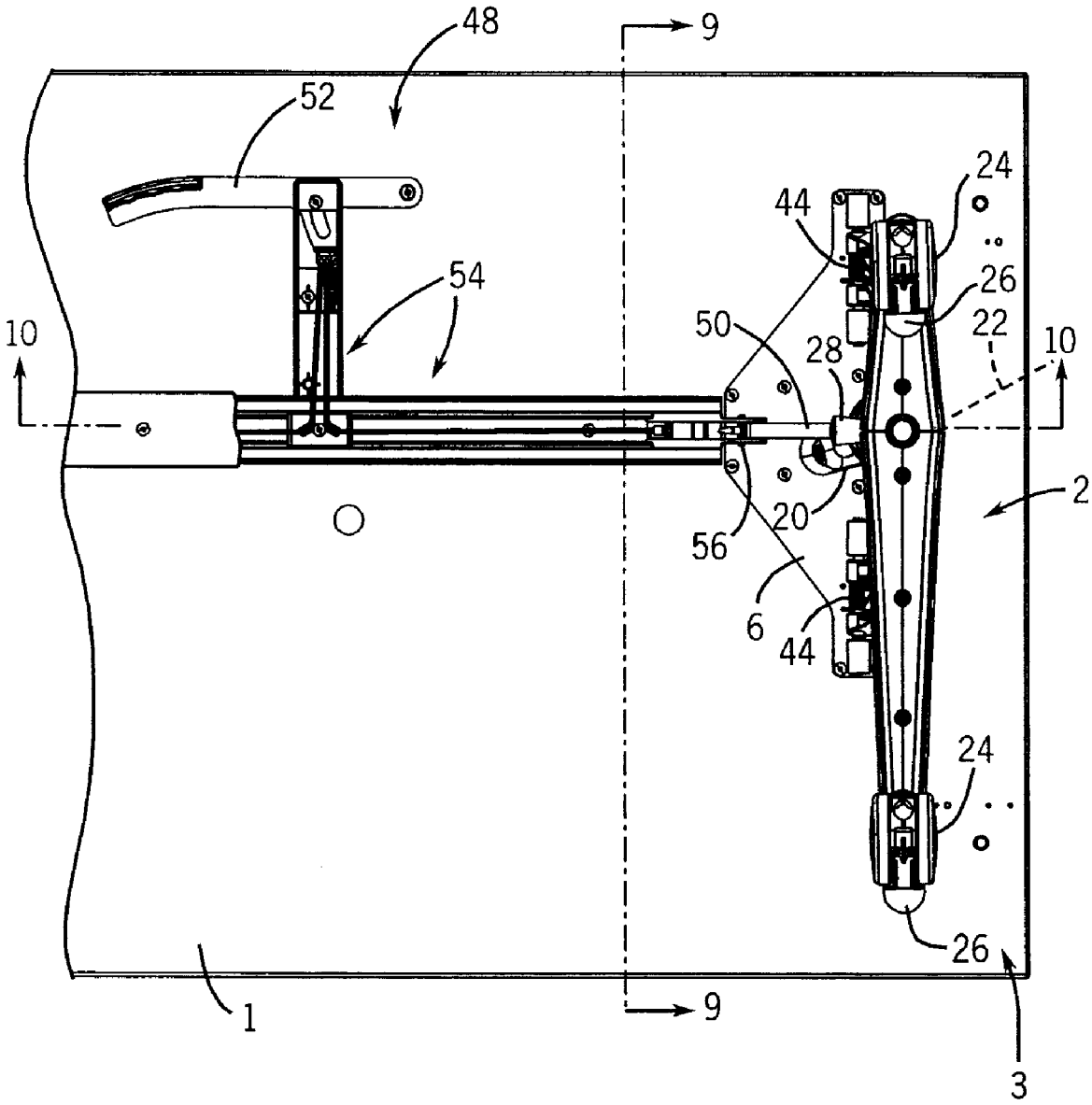
FIG. 8 is a partial, plan view of an underside of the table of FIG. 7 in the work position.
Figure 9:
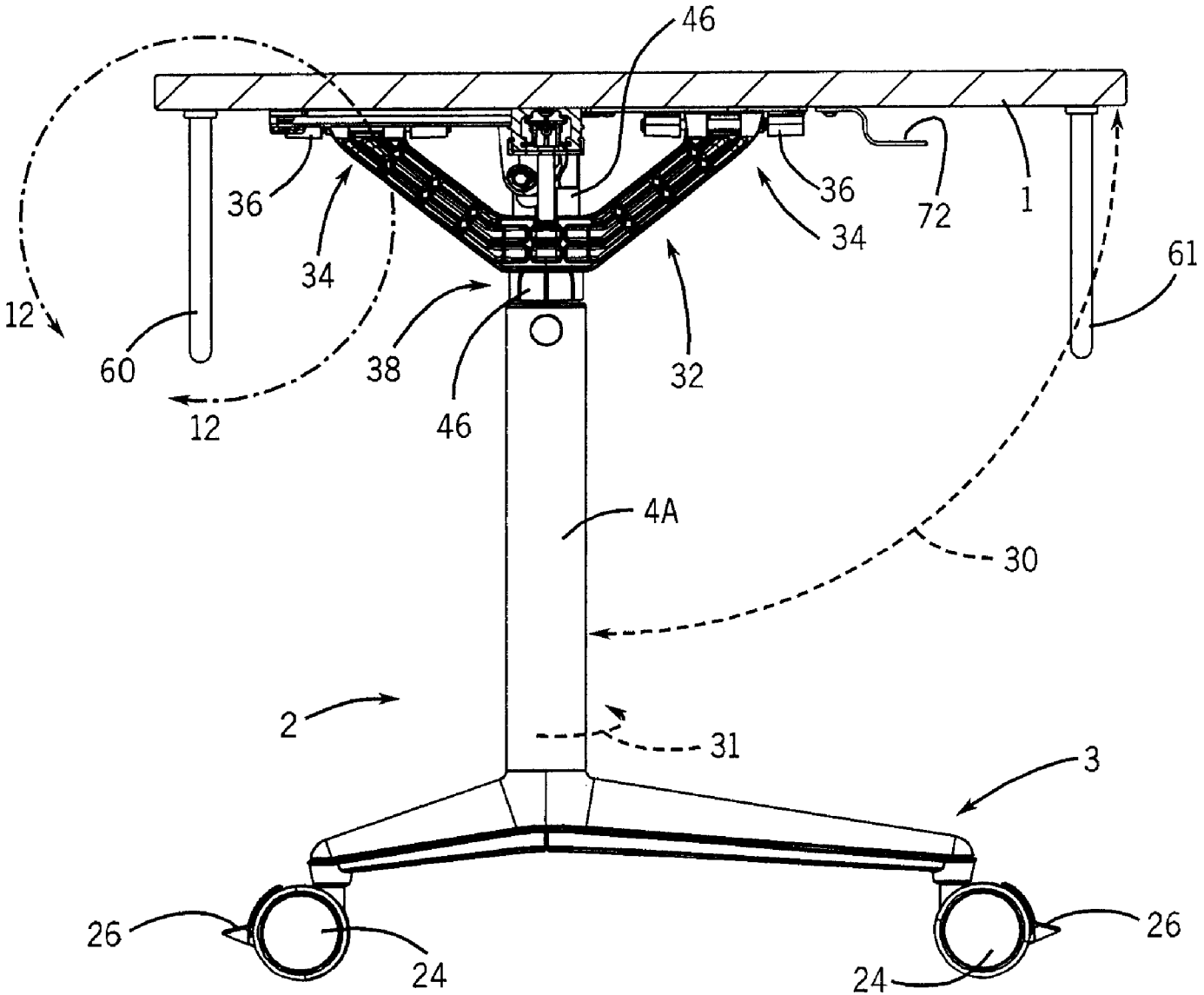
FIG. 9 is a side elevational view of the table of FIGS. 7 and 8 in the work position.
Figure 11:
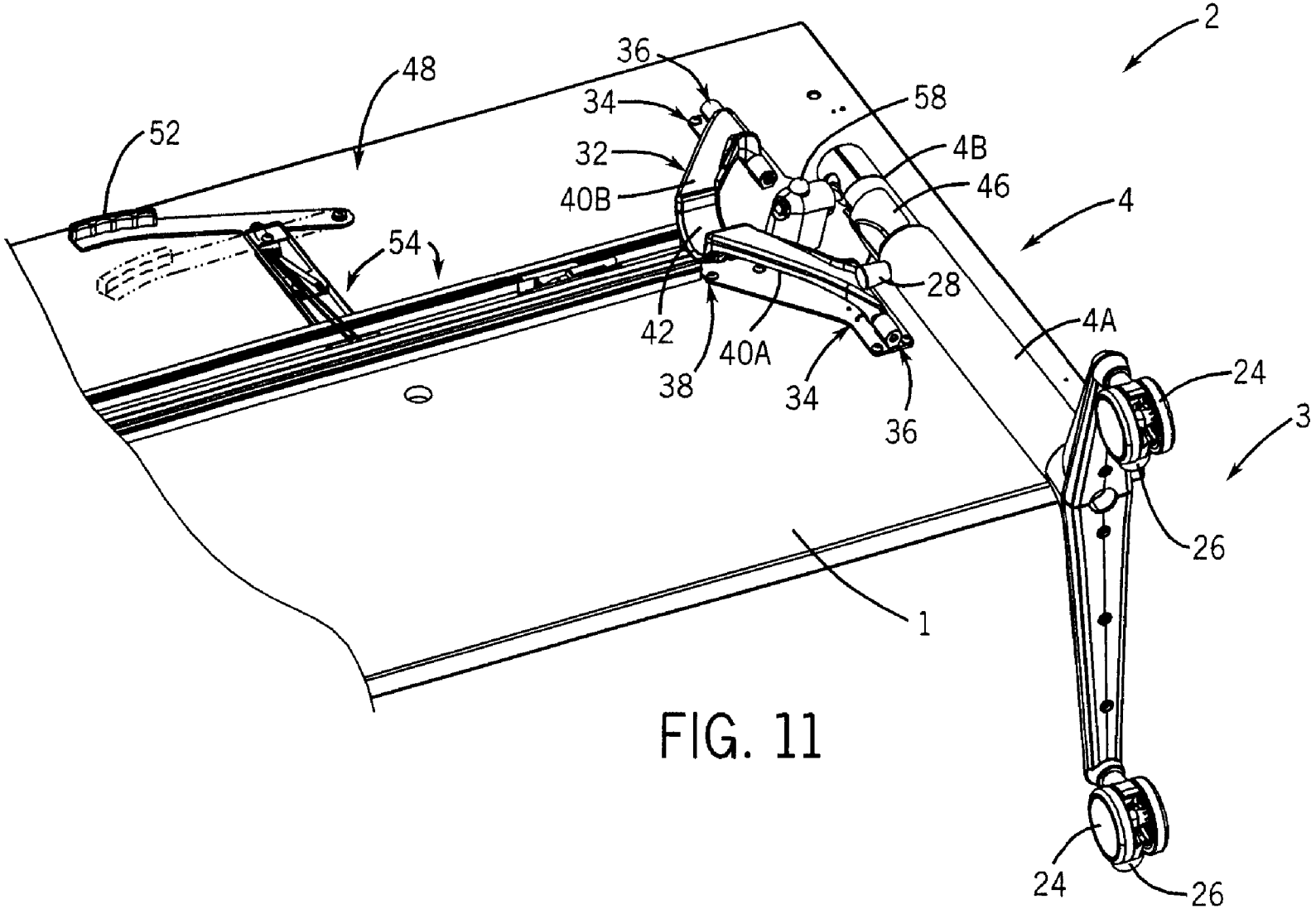
FIG. 11 is a perspective view of the table of FIGS. 7-10 in a storage position.

Referring now to FIGS. 7-11, and as best illustrated in FIGS. 9 and 11, the illustrated table system is configured to flip. Additionally, the illustrated table system includes a locking system configured to facilitate positioning the table system in a desired position. Specifically, the pivotable fitting 5 is designed to allow the board 1 to be rotated along a first path 30 between a first position, best shown in FIG. 9, where the board 1 is substantially perpendicular to the legs 2 and a second position, best shown in FIG. 11, where the board 1 is substantially parallel with the legs 2. As described above, motion of the board 1 along the first path 30 causes reciprocal motion of the legs 2. Referring to FIG. 7, this motion is best viewed by observing the feet 3, whereby motion of the board 1 about the pivotable fitting 5 is configured to automatically rotate the legs 2 and, therefore, the feet 3, along a second path 31 that is substantially transverse to the first path 30.

To facilitate arranging the board 1 in these positions, a locking mechanism 32 is provided. Specifically, the locking mechanism 32 extends from a first end 34 secured to the board 1 and mounting plate 6 through another pivotable fitting 36 to a second end 38 configured to rotate between a storage position, as shown in FIG. 11, where the locking mechanism 32 extends substantially parallel with the board 1, and a work position, as shown in FIG. 9, where the locking mechanism 32 extends substantially perpendicular to the board 1 and engages the leg 2 to lock the board in the first position.

The locking mechanism 32 includes two support arms 40*a*, 40*b* extending from the second pivotable fitting 36 to support a cupped portion 42 from opposing sides. To facilitate engaging the legs 2, the cupped portion 42 is designed to partially surround each leg 2 when in the work position to lock the board 1 in the first position. A biasing mechanism 44 may be included that pushes against the mounting plate 6 and support arms 40*a*, 40*b* to bias the locking mechanism 32 in the work position. In this regard, the locking mechanism 32 is configured to position the cupped 42 portion about a portion of the leg 2 when the board 1 is in the second position and overcome the biasing mechanism 44 to secure the locking mechanism 32 in the storage position.

A shield 46 may be arranged to extend along a portion of each leg 2 in an area engaged by the cupped portion 42 in the work position. The shield 46 is configured to protect each leg 2 from engaging the locking mechanism 32 when in both the work position and the storage position. For example, the shield 46 is configured to press against the locking mechanism 32 as the board 1 is moved between the first position and the second position. It is contemplated that the shield 46 may be formed of a resilient material, such as a polymer or plastic, that can withstand repeated contact with the cupped portion 42 and rubbing contact with the support arms 40*a*, 40*b* during movement of between the first and second positions.

To facilitate moving the board 1 from the first position shown in FIG. 9 to the second position shown in FIG. 11, a disengagement mechanism 48 may be provided to overcome the biasing mechanism 44 by disengaging the cupped portion 42 from the leg 2 and allow rotation about the first pivot axis 22 to, thereby, unlock the board 1 from the first position. The disengagement mechanism 48 includes a link 50 extending from the cupped portion 42 away from the leg 2 and toward the board 1 and coupled to a user interface 52 configured to receive a user actuation, as illustrated in FIG. 11, and transfer a force associated with the user actuation to the cupped portion 42 through the link 50. Specifically, as shown in FIGS. 8 and 11, the user interface 52 is mechanically linked through a series of connections 54 to the link 50, such that movement of the user interface 52 causes reciprocal movement of the link 50.

To secure the link 50 when the locking mechanism 32 is in the work position and protect against inadvertent movement, a clip 56 may be included that is mounted to the board 1 and configured to engage and secure an end of the link 50 opposite the locking mechanism 32 against the board 1 to lock the locking mechanism against the leg 2. Furthermore, the clip 56 is configured to release the link 50 as the locking mechanism 32 is moved from the work position toward the storage position through the transferred force applied to the user interface 52.

A bumper 58 may be included that is mounted on the base 20 and configured to extend above a plane formed by the board 1 and the leg 2 when the board and legs 2 are substantially parallel, as shown in FIG. 11. Accordingly, the bumper 58 protects the board 1, legs 2, and locking mechanism 32 from engaging an adjacent flip table nested therewith or arranged proximate thereto.

Figure 12:
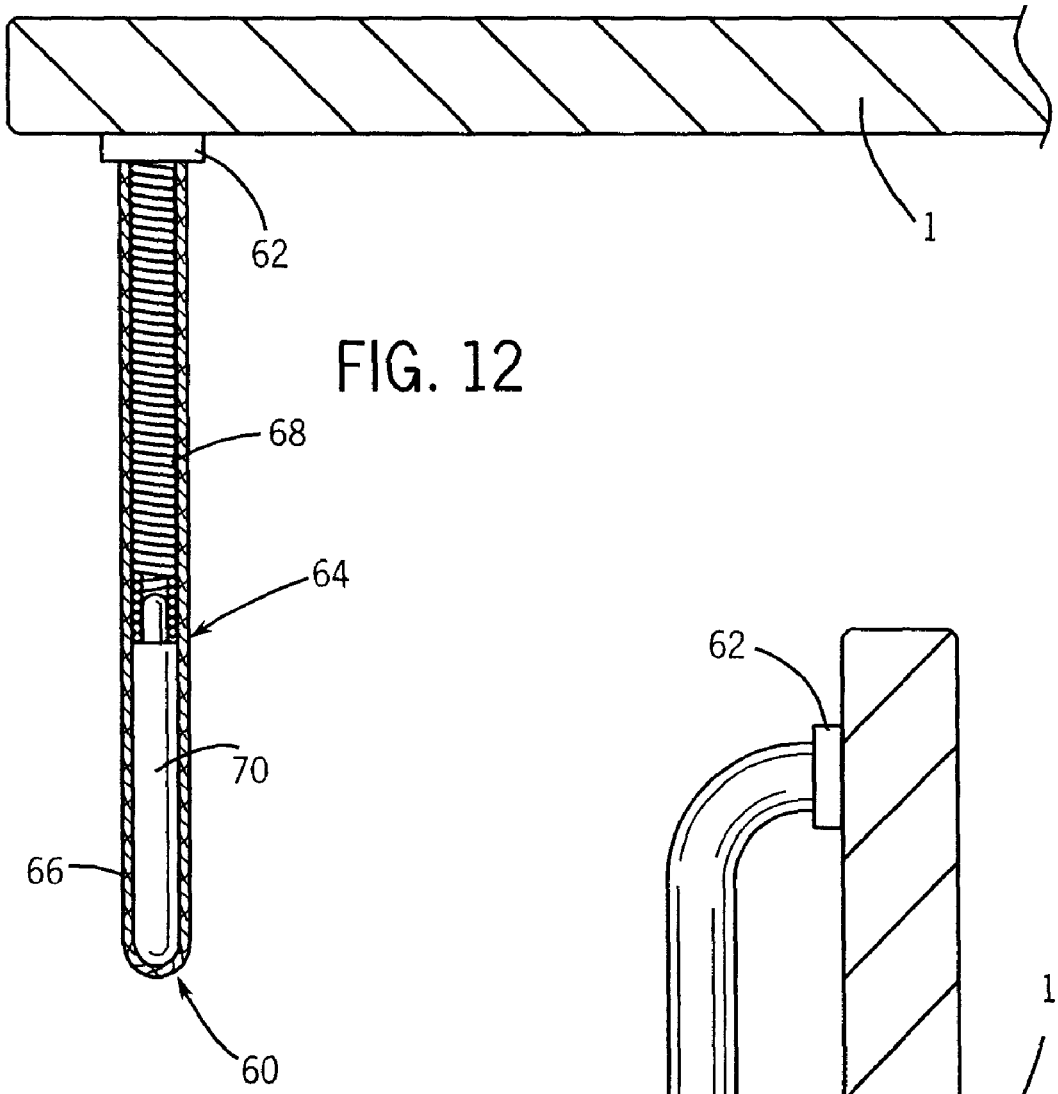
FIG. 12 is a cross-sectional view of an optional privacy shield for use with the flip table system of the present invention in a work position.
Figure 13:
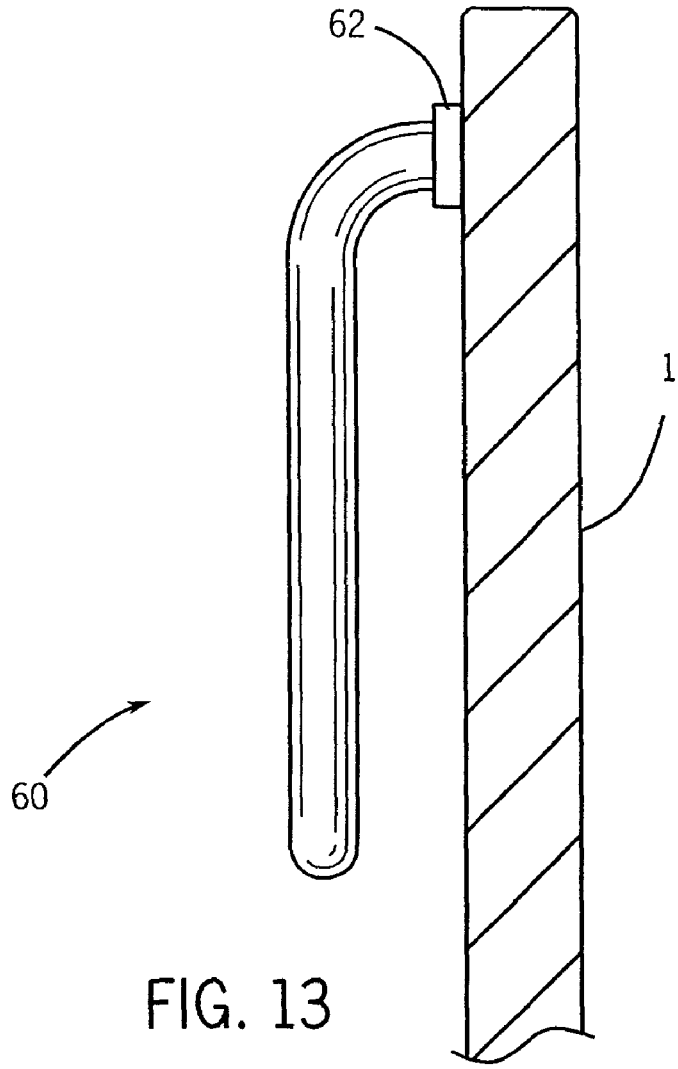
FIG. 13 is a side-elevational view of the optional privacy shield for use with the flip table system of the present invention in a storage position.

Referring now to FIGS. 9, 12, and 13, it is contemplated that one or more privacy shields 60, 61 may be included that are designed to extend below the board 1 and provide a visual shield to an underside of the system. The visual shield 60, 61 may be formed, primarily, of cloth or a similar flexible material that is controlled by a frame. Specifically, referring to FIGS. 12 and 13, the privacy shield 60 is mounted to the board 1, preferably, through a mounting bracket 62. The privacy shield 60, 61 is designed to hang from the mounting bracket 62 such that, when the board is in the horizontal working position illustrated in FIG. 12, the privacy shield 60, 61 extends substantially perpendicular down from the board 1. To aid in reaching the substantially perpendicular position illustrated in FIG. 12, it is contemplated that the privacy shield 60, 61 may include a frame 64 arranged within a cloth exterior 66. The frame 64 may include a biasing mechanism, for example, a spring 68. The spring 68 is arranged to bias the privacy shield 60, 61 to extend perpendicularly to the board 1.

With respect to the privacy shield 60 arranged on an end of the board 1 configured to rotate upward into the vertical storage position, to further aid in reaching this perpendicular position, it is contemplated that the frame 64 may also include a solid and/or weighted portion 70 arranged opposite the board 1. This solid and/or weighted portion 70 not only aids the privacy shield in reaching the position illustrated in FIG. 12, but also aids in repositioning the privacy shield 60 in a storage position, as illustrated in FIG. 13. That is, as the board 1 is rotated from the horizontal work position to the vertical storage position, the weight of the privacy shield 60 overcomes the bias of the spring 68 and the privacy shield 60 folds down, such that a majority of the privacy shield 60 extends parallel to the board 1. The inclusion of the solid and/or weighted portion 70 further aids in moving between these two positions. With respect to the privacy shield 61 arranged on an end of the board 1 configured to rotate downward into the vertical storage position, it is contemplated that a bracket 72 may be included to receive the privacy shield 61 and hold the privacy shield against the board 1.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A board comprising:

a worksurface;

at least one leg engaged at a first end of the at least one leg with the worksurface to support the worksurface;

a first pivotable fitting securing the at least one leg to the worksurface to allow the worksurface to be rotated along a first path between a first position where the worksurface is substantially perpendicular to the at least one leg and a second position where the worksurface is substantially parallel with the at least one leg; and a locking mechanism extending from a first end to a second end;

wherein the first end of the locking mechanism is secured to the worksurface through a second pivotable fitting; and wherein the locking mechanism is rotatable about the second pivotable fitting between a storage position at which the locking mechanism extends substantially parallel with the worksurface and a work position at which the locking mechanism extends substantially perpendicular to the worksurface such that the second end engages the at least one leg when the worksurface in the first position.

2. The board of claim 1 further comprising a biasing mechanism engaged with the worksurface and the locking mechanism, and configured to bias the locking mechanism in the work position.

3. The board of claim 2 wherein the at least one leg is configured to engage the locking mechanism when the worksurface is in the second position and overcome the biasing mechanism to secure the locking mechanism in the storage position.

4. The board of claim 1 wherein the locking mechanism includes a cupped portion configured to at least partially surround the at least one leg when the locking mechanism is in the work position to lock the worksurface in the first position by engaging the cupped portion with the at least one leg to inhibit rotation of the worksurface along the first path.

5. The board of claim 4 further comprising a biasing mechanism configured to bias the locking mechanism in the work position to engage the cupped portion with the at least one leg.

6. The board of claim 5 further comprising a disengagement mechanism configured to overcome the biasing mechanism by disengaging the cupped portion from the at least one leg to unlock the worksurface from the first position.

7. The board of claim 6 wherein the disengagement mechanism includes a link extending from the cupped portion away from the at least one leg and toward the worksurface and coupled to a user interface configured to receive a user actuation and transfer a force associated with the user actuation to the cupped portion through the link.

8. The board of claim 7 further comprising a clip configured to receive a portion of the link proximate the worksurface and secure the link to the worksurface when the locking mechanism is in the work position and release the link as the locking mechanism is moved from the work position toward the storage position.

9. The board of claim 4 wherein the locking mechanism includes at least one support arm extending from the second pivotable fitting to support the cupped portion.

10. The board of claim 9 wherein the at least one support arm includes a pair of support arms, wherein the second pivotable fitting includes a pair of second pivotable fittings, and wherein each of the pair of support arms extends from one of the pair of second pivotable fittings to support the cupped portion from opposing sides.

11. The board of claim 4 further comprising a shield extending along a portion of the at least one leg and engaged by the cupped portion when the locking mechanism is in the work position.

12. The board of claim 11 wherein the shield is configured to protect the at least one leg from engaging the locking mechanism when the locking mechanism is in both the work position and the storage position.

13. The board of claim 12 further comprising a biasing mechanism configured to bias the locking mechanism in the work position and wherein the shield is configured to press against the locking mechanism as the worksurface is moved between the first position and the second position.

14. The board of claim 1 further comprising at least one foot extending from a second end of the at least one leg and wherein the first pivotable fitting includes a pivot axis extending in a direction slanted with respect to at least one of the worksurface and the at least one leg to rotate the at least one foot along a second path transverse to the first path as the worksurface is rotated along the first path.

15. The board of claim 1 wherein the first pivotable fitting includes a pivot axis extending in a direction slanted with respect to at least one of the worksurface and the at least one leg.

16. The board of claim 1 wherein the first pivotable fitting includes a base extending in a first direction away from the worksurface to form a pivot axis at an end opposite the worksurface that extends not parallel with the worksurface when the worksurface is in the first position.

17. The board of claim 16 further comprising a bumper mounted on the base and configured to extend above a plane formed by the worksurface and the at least one leg when the worksurface and the at least one leg are substantially parallel to protect the worksurface, the at least one leg, and the locking mechanism from engaging an adjacent worksurface arranged proximate thereto.

18. The board of claim 1 wherein the first pivotable fitting forms a pivot axis extending neither parallel nor perpendicular to at least one of the worksurface and the at least one leg.

19. The board of claim 1 further comprising a privacy shield defining a mass and mounted to the worksurface such that the mass of the privacy shield is urged by gravity to extend the privacy shield substantially perpendicular to the worksurface when the worksurface is in the first position and move the privacy shield, such that a majority of the privacy shield extends substantially parallel with the worksurface, when the worksurface is rotated along the first path to the second position.

20. The board of claim 19 wherein the privacy shield includes a flexible covering and a biasing mechanism arranged within the flexible covering configured to bias the privacy shield to extend substantially perpendicular to the worksurface when the worksurface is in the first position.

21. The board of claim 20 wherein the biasing mechanism is configured to be overcome as the worksurface is rotated along the first path to the second position to cause the majority of the privacy shield to extend substantially parallel with the worksurface.

22. The board of claim 1 wherein worksurface forms one of a tabletop, an easel, a display, a blackboard, and a podium.

23. A system comprising:

a board having opposing surfaces;

at least one leg connected to one surface of the board through a first pivotable fitting to allow the board and the at least one leg to move between a first position wherein the board and the at least one leg are substantially parallel and a second position wherein the board and the at least one leg are substantially perpendicular; and a locking mechanism secured to the board through a second pivotable fitting at a first end of the locking mechanism and configured to rotate such that a second end of the locking mechanism opposite the first end moves between a storage position at which the locking mechanism extends parallel with the board and a work position at which the locking mechanism extends perpendicular to the board and end engages the at least one leg.

24. The system of claim 23 wherein the first pivotable fitting forms a pivot axis extending through a plane formed by the board and a line formed by the at least one leg.

25. The system of claim 24 wherein movement of the board about the pivot axis causes movement of the at least one leg about the pivot axis.

26. The system of claim 24 wherein the board includes a plurality of side surfaces extending between the opposing surfaces to form a plurality of corners thereabout and wherein the first pivot axis is slanted with respect to the plurality of corners.

27. The system of claim 23 further comprising a biasing mechanism engaged with the board and the locking mechanism, and configured to bias the locking mechanism in the work position.

28. The system of claim 27 wherein the at least one leg is configured to engage the locking mechanism when the board is in the second position and overcome the biasing mechanism to secure the locking mechanism in the storage position.

29. The system of claim 23 wherein the locking mechanism includes a cupped portion configured to at least partially surround the at least one leg when the locking mechanism is in the work position to lock the board in the first position by engaging the cupped portion with the at least one leg to inhibit movement of the board between the first position and the second position.

30. The system of claim 29 further comprising a biasing mechanism configured to bias the locking mechanism in the work position to engage the cupped portion with the at least one leg.

31. The system of claim 30 further comprising a disengagement mechanism configured to overcome the biasing mechanism by disengaging the cupped portion from the at least one leg to unlock the board from the first position.

32. The system of claim 31 wherein the disengagement mechanism includes a link extending from the cupped portion away from the at least one leg and toward the board and coupled to a user interface configured to receive a user actuation and transfer a force associated with the user actuation to the cupped portion through the link.

33. The system of claim 32 further comprising a clip configured to receive a portion of the link proximate the board and secure the link to the board when the locking mechanism is in the work position and release the link as the locking mechanism is moved from the work position toward the storage position.

34. The system of claim 29 wherein the locking mechanism includes at least one support arm extending from the second pivotable fitting to support the cupped portion.

35. The system of claim 34 wherein the at least one support arm includes a pair of support arms, wherein the second pivotable fitting includes a pair of second pivotable fittings, and wherein each of the pair of support arms extends from one of the pair of second pivotable fittings to support the cupped portion from opposing sides.

36. The system of claim 29 further comprising a shield extending along a portion of the at least one leg and engaged by the cupped portion when the locking mechanism is in the work position.

37. The system of claim 36 wherein the shield is configured to protect the at least one leg from engaging the locking mechanism when the locking mechanism is in both the work position and the storage position.

38. The system of claim 37 further comprising a biasing mechanism configured to bias the locking mechanism in the work position and wherein the shield is configured to press against the locking mechanism as the board is moved between the first position and the second position.

39. The system of claim 23 further comprising at least one foot extending from a second end of the at least one leg and wherein the first pivotable fitting includes a pivot axis extending in a direction slanted with respect to at least one of the board and the at least one leg to rotate the at least one foot along a second path transverse to the first path as the board is rotated along the first path.

40. The system of claim 23 wherein the first pivotable fitting includes a pivot axis extending in a direction slated with respect to at least one of the board and the at least one leg.

41. The system of claim 23 wherein the first pivotable fitting includes a base extending in a first direction away from the board to form a pivot axis at an end opposite the board that extends not parallel with the board when the board is in the first position.

42. The system of claim 41 further comprising a bumper mounted on the base and configured to extend above a plane formed by the board and the at least one leg when the board and the at least one leg are substantially parallel to protect the board, the at least one leg, and the locking mechanism from engaging an adjacent board arranged proximate thereto.

43. The system of claim 23 wherein the first pivotable fitting forms a pivot axis extending neither parallel nor perpendicular to at least one of the board and the at least one leg.

44. The system of claim 23 further comprising a privacy shield defining a mass and mounted to the board such that the mass of the privacy shield is urged by gravity to extend the privacy shield substantially perpendicular to the board when the board is in the second position and move the privacy shield, such that a majority of the privacy shield extends substantially parallel with the board, when the board is moved to the first position.

45. The system of claim 44 wherein the privacy shield includes a flexible covering and a biasing mechanism arranged within the flexible covering configured to bias the privacy shield to extend substantially perpendicular to the board when the board is in the second position.

46. The system of claim 45 wherein the biasing mechanism is configured to be overcome as the board is moved to the first position to cause the majority of the privacy shield to extend substantially parallel with the board.

* * * * *

UNITED STATES PATENT AND TRADEMARK OFFICE

CERTIFICATE OF CORRECTION

PATENT NO. : 7,878,128 B2
APPLICATION NO. : 11/756158
DATED : February 1, 2011
INVENTOR(S) : Watson et al.

It is certified that error appears in the above-identified patent and that said Letters Patent is hereby corrected as shown below:

IN THE CLAIMS:

Column 9, Claim 23, line 44, “and end engages” should be --and engages--.

Signed and Sealed this
Fifth Day of April, 2011

David J. Kappos

David J. Kappos
*Director of the United States Patent and Trademark Office*